US007810344B2

(12) United States Patent
Yoon et al.

(10) Patent No.: US 7,810,344 B2
(45) Date of Patent: Oct. 12, 2010

(54) WATER TANK AND REFRIGERATOR HAVING THE SAME

(75) Inventors: Jong Seok Yoon, Changwon-Si (KR); Byeong Gyu Kang, Changwon-Si (KR); Jae Youl Lee, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 391 days.

(21) Appl. No.: 11/766,664

(22) Filed: Jun. 21, 2007

(65) Prior Publication Data

US 2007/0295023 A1 Dec. 27, 2007

(30) Foreign Application Priority Data

Jun. 23, 2006 (KR) ..... 10-2006-0057056

(51) Int. Cl.

| | |
|---|---|
| ***F25D 23/12*** | (2006.01) |
| ***F25D 3/00*** | (2006.01) |
| ***B65D 90/02*** | (2006.01) |
| ***F16K 31/08*** | (2006.01) |
| ***F16K 31/44*** | (2006.01) |

(52) U.S. Cl. ..... 62/338; 220/565; 62/389; 251/65; 251/66; 251/69

(58) Field of Classification Search ..... 62/389, 62/338; 251/65, 66, 69; 137/909
See application file for complete search history.

(56) References Cited

U.S. PATENT DOCUMENTS

| | | | | |
|---|---|---|---|---|
| 2,652,065 | A * | 9/1953 | Kutzler | 137/66 |
| 2,875,616 | A * | 3/1959 | Marks | 74/2 |
| 4,121,741 | A * | 10/1978 | Adamson | 222/181.2 |
| 4,938,120 | A * | 7/1990 | Hafele et al. | 92/16 |
| 5,555,743 | A * | 9/1996 | Hatanaka | 62/347 |
| 5,904,054 | A * | 5/1999 | Lee | 62/347 |
| 6,003,734 | A * | 12/1999 | Oh | 222/146.6 |
| 6,648,012 | B2 * | 11/2003 | Linthorst | 137/522 |
| 2007/0012061 | A1 * | 1/2007 | Ribeiro et al. | 62/344 |

FOREIGN PATENT DOCUMENTS

| | | |
|---|---|---|
| KR | 1998-0003421 A | 3/1998 |
| KR | 1998-0003423 A | 3/1998 |
| KR | 1998-022602 U | 7/1998 |

* cited by examiner

*Primary Examiner*—Cheryl J Tyler
*Assistant Examiner*—Filip Zec
(74) *Attorney, Agent, or Firm*—Birch, Stewart, Kolasch & Birch, LLP

(57) ABSTRACT

Disclosed are a water tank and a refrigerator having the same. The water tank includes a tank main body provided with a water storage space formed therein and a discharge hole; a tank cover connected to the tank main body for opening and closing the water storage space; a valve movably installed in the tank main body for opening and closing the discharge hole; and a valve driving unit moving the valve using magnetic force so as to cause the valve to open and close the discharge hole. The water tank is opened and closed by the magnetic force of magnets and the restoring force of elastic members, and thus it is possible to prevent water stored in the water tank from leaking out in a process of attaching or detaching the water tank to or from the rear surface of a door or a refrigerator.

6 Claims, 10 Drawing Sheets

WATER TANK AND REFRIGERATOR HAVING THE SAME

This application claims the benefit of Korean Patent Application No. 10-2006-0057056, filed Jun. 23, 2006, which is hereby incorporated by reference as if fully set forth herein.

BACKGROUND OF THE INVENTION

1. Field of the Invention

The present invention relates to a water tank and a refrigerator having the same, and more particularly, to a water tank for supplying water, temporarily stored therein, to an ice maker without leakage of the water, and a refrigerator having the same.

2. Discussion of the Related Art

Generally, refrigerators are electric appliances for keeping foods in a fresh state by freezing or cooling the foods, and usually include a freezing chamber and a refrigerating chamber. Further, an ice maker for making ice is provided in the freezing chamber.

FIG. 8 is a front view illustrating the internal structure of a conventional refrigerator, FIG. 9 is an exploded perspective view of a water tank provided in the refrigerator of FIG. 8, and FIG. 10 is a longitudinal sectional view of the water tank in a state in which the water tank is installed on a door of the refrigerator of FIG. 8.

As shown in FIGS. 8 to 10, a freezing chamber 11 and a refrigerating chamber 13 are provided in a main body 10 of a conventional refrigerator, and a freezing chamber door 11*a* and a refrigerating chamber door 13*a* are rotatably installed on the main body 10. The freezing chamber door 11*a* and the refrigerating chamber door 13*a* serve to selectively open and close the freezing chamber 11 and the refrigerating chamber 13, respectively.

A plurality of door baskets 14 for receiving foods are detachably installed on the rear surfaces of the freezing chamber door 11*a* and the refrigerating chamber door 13*a*, and home bars 15 and 16, through which ice and beverages can taken into and out of the refrigerator without opening the freezing chamber door 11*a* and the refrigerating chamber door 13*a*, are respectively provided in the freezing chamber door 11*a* and the refrigerating chamber door 13*a*.

First and second ice maker housings 17 and 19 are provided on the freezing chamber door 11*a* at a designated position above the home bar 15, and an ice tray (not shown) for making ice is installed in the first ice maker housing 17. An ice bank (not shown) for taking the ice, made by the ice tray, out of the refrigerator through the home bar 15 is installed in the second ice maker housing 19.

A mounting space is formed between any one of the door baskets 14, installed on the rear surface of the freezing chamber door 11*a*, and the first ice maker housing 17, and a water tank 21 is detachably installed in the mounting space. The water tank 21 stores water, which will be supplied to the ice tray. As shown in FIG. 9, the water tank 21 includes a tank main body 22, a tank cover 23, a supply hole cover 24, and a valve 25.

The tank main body 22 has a polyhedral shape, the upper portion of which is opened, and a water storage space 22*s* for storing a designated amount of water is provided in the tank main body 22. A support protrusion 22*a* is provided on the inner surface of the edge of the tank main body 22, and a knob part 22*b*, which is held by user's hand so as to attach and detach the water tank 21 to and from the mounting space, is provided on one side of the lower surface of the tank main body 22.

A guide groove 22*c* for guiding the water tank 21 is formed in the lower surface of the tank main body 22 by upwardly indenting a part of the lower surface of the tank main body 22, and a guide rib 17*a* provided on the upper surface of the first ice maker housing 17 is inserted into the guide groove 22*c*.

The tank cover 23 is connected to the upper portion of the tank main body 22 so as to selectively open and close the water storage space 22*s*, and the edge of the lower surface of the tank cover 23 is supported by the upper surface of the support protrusion 22*a*. A supply hole 23*h* for supplying water from an external water source to the water storage space 22*c* is formed through a designated position of the tank cover 23, and a packing groove 23*a* surrounding the supply hole 23*h* is formed in the upper surface of the tank cover 23.

A receipt stage 23*b*, on which the supply hole cover 24 is laid under the condition that the supply hole cover 24 closes the supply hole 23*h* of the tank cover 23, is formed on the upper surface of the tank cover 23. The receipt stage 23*b* is obtained by stepping a part of the tank cover 23 including the supply hole 23*h* and the packing groove 23*a*.

A knob groove 23*c*, into which a user's hand is inserted, for rotating the supply hole cover 24 against the tank cover 23 is formed in the upper surface of the tank cover 23, and a contacting protrusion 24*a* and a packing protrusion 24*b* are provided on the lower surface of the supply hole cover 24. Under the condition that the supply hole cover 24 closes the supply hole 23*h* of the tank cover 23, the outer circumferential surface of the contacting protrusion 24*a* contacts the inner surface of the supply hole 23*h*, and the packing protrusion 24*b* is inserted into the packing groove 23*a*.

With reference to FIG. 10, a discharge hole 22*h* for supplying the water stored in the water storage space 22 to the ice tray is formed through a designated position of the lower surface of the tank main body 22. The discharge hole 22*h* is connected to a water supply hole 17*h* formed through the upper surface of the first ice maker housing 17 under the condition that the water tank 21 is installed in the above mounting space, and an insertion rib 22*r* is provided on the lower surface of the tank main body 22 corresponding to the circumference of the discharge hole 22*h*.

The valve 25 includes a valve bracket 26, a valve main body 27, a packing ring 28*a*, and a first elastic member 29. The valve bracket 26 is provided along the circumference of the discharge hole 22*h* of the tank main body 22, and a water supply hole 26*h* for substantially supplying the water stored in the water storage space 22*s* to the ice tray therethrough is formed through the valve bracket 26.

A receipt groove 26*a* is formed in a designated position of the upper surface of the valve bracket 26 adjacent to the water supply hole 26*h*, and the outer circumferential surface of the packing ring 28*a* is laid on the receipt groove 26*a*.

An insertion groove 26*b*, into which the insertion rib 22*r* of the tank main body 22 is inserted, is formed in the upper surface of the valve bracket 26, and a fixing hook 26*c*, which is caught by the bottom surface of the tank main body 22 under the condition that the insertion rib 22*r* is inserted into the insertion groove 26*b*, is provided on the upper surface of the valve bracket 26 inside the insertion groove 26*b*.

The valve main body 27 passes through the water supply hole 26*h* of the valve bracket 26, and is vertically movable. When the water tank 21 is installed in the mounting space, the valve main body 27 moves upwardly by means of a driving protrusion (not shown) provided on the upper surface of the first ice maker housing 17, and thus opens the water supply hole 26*h* of the valve bracket 26.

An insertion groove 27*a*, into which the inner circumferential surface of the packing ring 28*a* is inserted, is formed in the upper end of the valve main body 27, and a flange part 27*f*, the upper surface of which supports one end of the first elastic member 29, is provided on the lower end of the valve main body 27. A water supply hole 27*h* is formed through a position of the flange part 27*f* corresponding to the water supply hole 26*h* of the valve bracket 26.

A packing member 28*b* is provided between the insertion rib 22*r* of the tank main body 22 and the insertion groove 26*b* of the valve bracket 26, and both ends of the first elastic member 29 are respectively supported by the lower surface of the valve bracket 26 and the upper surface of the flange part 27*f* of the valve main body 27.

The above-described conventional water tank and the refrigerator having the same, have several problems, as described below.

The valve main body 27 moves upwardly by means of the driving protrusion provided on the upper surface of the first ice maker housing 17 and thus opens the water supply hole 26*h* of the valve bracket 26. Thereby, the water stored in the water storage space 22*s* is supplied to the ice tray through the discharge hole 22*h* of the water tank 21.

Accordingly, when the valve main body 27 moves upwardly by means of the driving protrusion and thus opens the water supply hole 26*h* of the valve bracket 26 under the condition that the water tank 21 is not completely installed in the mounting space, the water stored in the water storage space 22*s* may leak out through the discharge hole 22*h* of the water tank 21.

SUMMARY OF THE INVENTION

Accordingly, the present invention is directed to a water tank and a refrigerator having the same.

One object of the present invention is to provide a water tank, which prevents water stored therein from leaking out in a process of attaching or detaching the water tank to or from the rear surface of a door of a refrigerator, and a refrigerator having the water tank.

To achieve this object and other advantages and in accordance with the purpose of the invention, as embodied and broadly described herein, a water tank comprises a tank main body provided with a water storage space formed therein and a discharge hole; a tank cover connected to the tank main body for opening and closing the water storage space; a valve movably installed in the tank main body for opening and closing the discharge hole; and a valve driving unit moving the valve using magnetic force so as to cause the valve to open and close the discharge hole.

The valve driving unit includes a movable magnet movably installed on the tank cover; and a stationary magnet installed on the valve.

Preferably, the tank cover includes a guide unit for guiding the movement of the movable magnet.

More preferably, the guide unit includes guide slots formed in the upper surface of the tank cover.

The valve includes a first elastic member for providing restoring force in the direction opposite to the attractive force between the movable magnet and the stationary magnet.

Preferably, the movable magnet is provided with a lever for facilitating the movement of the movable magnet.

Further, preferably, the tank cover includes second elastic members for providing restoring force in the direction of moving the movable magnet far away from the stationary magnet.

The valve includes a valve bracket installed in the discharge hole and provided with a water supply hole; and a valve main body provided with a stationary magnet installed thereon and serving to open and close the water supply hole.

Preferably, water leak prevention rib is provided on the lower surface of the tank main body adjacent to the discharge hole.

In another aspect of the present invention, a refrigerator having a water tank, comprises a tank main body installed on the rear surface of a door, and provided with a water storage space formed therein and a discharge hole; a tank cover connected to the tank main body for opening and closing the water storage space; a valve movably installed in the tank main body for opening and closing the discharge hole; and a valve driving unit moving the valve so as to cause the valve to open and close the discharge hole, and including a movable magnet movably installed on the tank cover and a stationary magnet installed on the valve.

A lever for facilitating the movement of the movable magnet is protruded from the movable magnet.

The water tank is installed under a door basket, and an interlocking protrusion for moving the lever close to the stationary magnet, when the water tank is installed, is formed on the door basket.

Preferably, the tank cover includes guide slots for guiding the movement of the movable magnet.

More preferably, the valve includes a first elastic member for providing restoring force in the direction opposite to the attractive force between the movable magnet and the stationary magnet.

The valve includes a valve bracket installed in the discharge hole and provided with a water supply hole; and a valve main body provided with the stationary magnet installed thereon and serving to open and close the water supply hole.

Preferably, the tank cover includes second elastic members for providing restoring force in the direction of moving the movable magnet far away from the stationary magnet.

More preferably, a water leak prevention rib is provided on the lower surface of the tank main body adjacent to the discharge hole.

Due to the above construction, it is possible to prevent water stored in the water tank from leaking out in a process of attaching or detaching the water tank to or from the rear surface of the door of the refrigerator.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
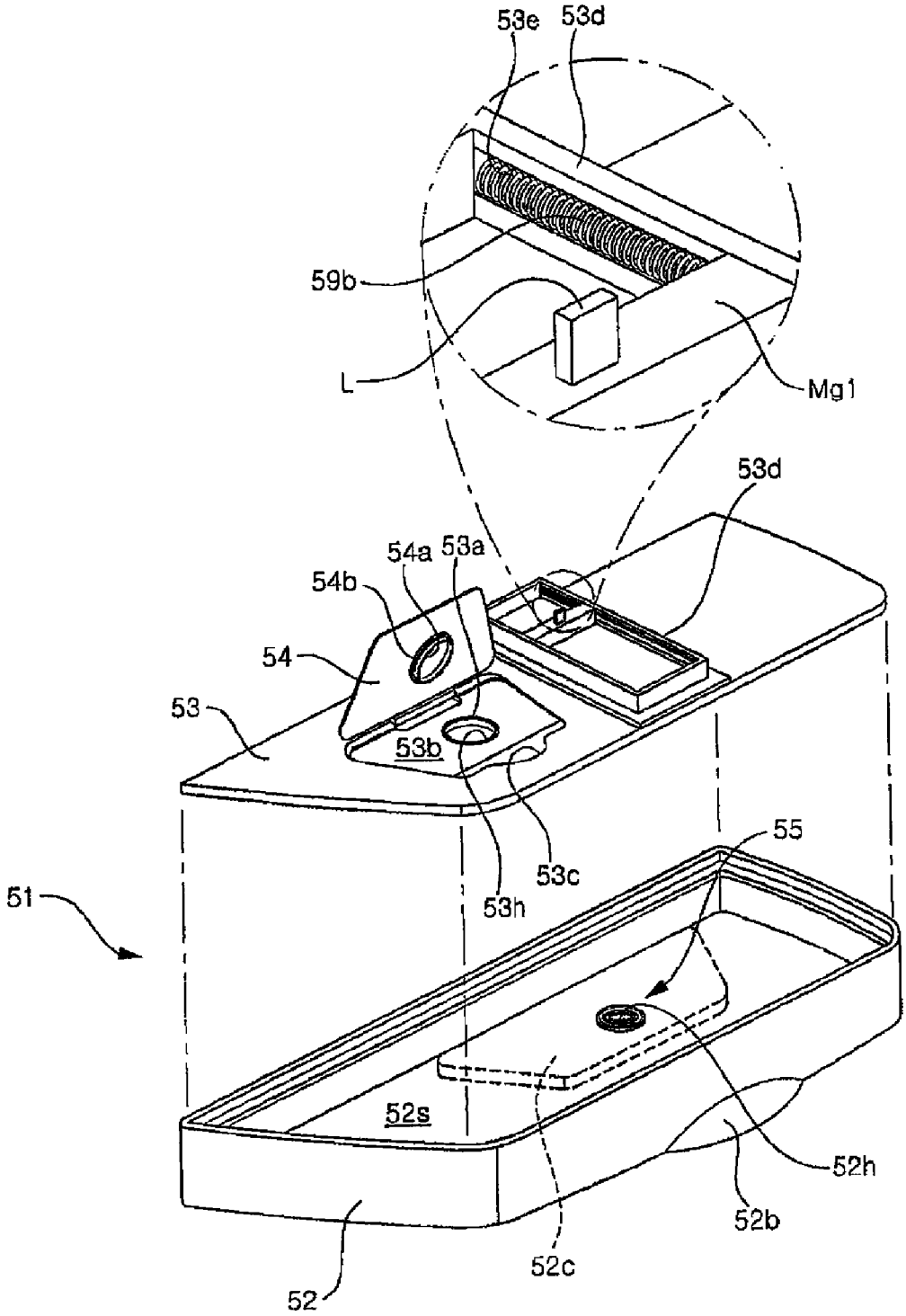
FIG. 1 is an exploded perspective view of a water tank in accordance with the present invention.
Figure 2:
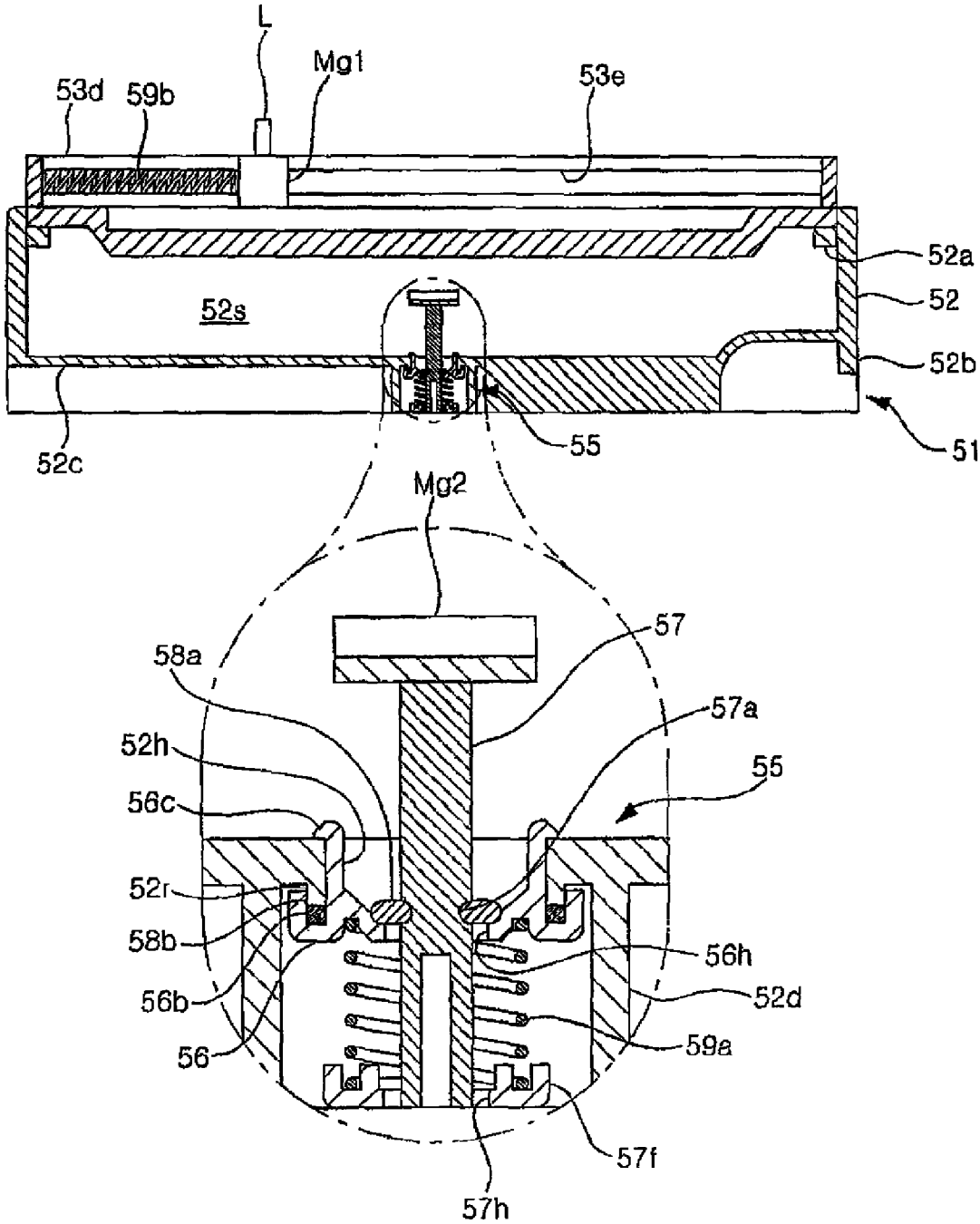
FIG. 2 is a longitudinal sectional view of FIG. 1.

FIG. 1 is an exploded perspective view of a water tank in accordance with the present invention, and FIG. 2 is a longitudinal sectional view of FIG. 1.

As shown in FIGS. 1 and 2, a water tank 51 in accordance with the present invention includes a tank main body 52, a tank cover 53, a valve 55, and a valve driving unit having a movable magnet Mg1 and a stationary magnet Mg2.

The tank main body 52 stores water for making ice, and has a polyhedral shape, the upper portion of which is opened. A water storage space 52*s* for storing a designated amount of water is provided in the tank main body 52. At least a part of the tank main body 52 is made of a transparent material or a semi-transparent material so that the amount of the water stored in the water storage space 52*s* of the water tank 51 can be recognized from the outside.

A support protrusion 52*a* is provided on the inner surface of the edge of the tank main body 52. The support protrusion 52*a* is protruded from the upper end of the inner surface of the edge of the tank main body 52 to a designated thickness. The edge of the lower surface of the tank cover 53, which will be described later, is supported by the upper surface of the support protrusion 52*a*.

A knob part 52*b* is provided on one side of the lower surface of the tank main body 52. The knob part 52*b* is held by user's hand so as to attach and detach the water tank 51 to and from a mounting space provided on the rear surface of the freezing chamber door 11*a*, and is formed by upwardly indenting a part of the lower surface of the tank main body 52.

A guide groove 52*c* is formed in the lower surface of the tank main body 52. The guide groove 52*c* serves to guide the water tank 51 in a process of installing or removing the water tank 51 in or from the mounting space. The guide groove 52*c* is formed by upwardly indenting a part of the lower surface of the tank main body 52 including a discharge hole 52*h* to a designated height.

When the water tank 51 is installed in or separated from the mounting space, the water tank 51 slides under the condition that a guide rib 17*a* provided on the bottom surface of the mounting space, i.e., on the upper surface of a first ice maker housing 17, is inserted into both side ends of the guide groove 52*c*.

The discharge hole 52*h* is formed through a designated position of the lower surface of the tank main body 52, and water stored in the water storage space 52*s* of the water tank 51 is supplied to an ice tray for making ice through the discharge hole 52*h*. The discharge hole 52*h* is connected to a water supply hole 17*h* formed through the upper surface of the first ice maker housing 17.

An insertion rib 52*r* is provided on the lower surface of the tank main body 52 corresponding to the circumference of the discharge hole 52*h*. The insertion rib 52*r* is protruded downwardly to a designated height.

A water leak prevention rib 52*d* is provided on the lower surface of the tank main body 52 adjacent to the discharge hole 52*h*. The water leak prevention rib 52*d* is protruded downwardly from the lower surface of the tank main body 52 adjacent to the discharge hole 52*h*. When the water tank 51 is installed in the mounting space, the lower end of the water leak prevention rib 52*d* contacts closely the upper surface of the first ice maker housing 17 adjacent to the water supply hole 17*h*.

The tank cover 53 for selectively opening and closing the water storage space 52*s* of the water tank 51 is connected to the upper portion of the tank main body 52, and the edge of the lower surface of the tank cover 53 is supported by the upper surface of the support protrusion 52*a* under the condition that the tank cover 53 is connected to the tank main body 52. Here, the upper surface of the tank cover 53 is coplanar with the upper end of the edge of the tank main body 52.

A supply hole 53*h* is formed through a designated position of the tank cover 53, and water supplied from an external water source (not shown) is stored in the water storage space 52*s* of the water tank 51 through the supply hole 53*h*. A packing groove 53*a* is formed in the upper surface of the tank cover 53. The packing groove 53*a* surrounds the supply hole 53*a* such that the packing groove 53*a* is separated from the circumference of the supply hole 53*a* by a designated distance.

A receipt stage 53*b* is formed on the tank cover 53. The receipt stage 53*b* is obtained by stepping a part of the tank cover 53 including the supply hole 53*h* and the packing groove 53*a*. A supply hole cover 54, which will be described later, is laid on the receipt stage 53*b* under the condition that the supply hole cover 54 closes the supply hole 53*h* of the tank cover 53.

A knob groove 53*c* is formed in the tank cover 53, and is connected to the receipt stage 53*b*. The knob groove 53*c* is a portion, into which a user's hand is inserted, for rotating the supply hole cover 54 against the tank cover 53. For this reason, the knob groove 53*c* is obtained by indenting a part of the tank cover 53 more deeply than the receipt stage 53*b*.

A guide frame 53*d* is provided on the upper surface of the tank cover 53 adjacent to the receipt stage 53*d*. The guide frame 53*d* has an approximately rectangular shape, and is located above the discharge hole 52*h* under the condition that the tank cover 53 is connected to the upper portion of the tank main body 52.

In this embodiment, as shown in FIGS. 1 and 2, the guide frame 53*d* is extended in the direction of the short side of the tank cover 53 so that one end of the guide frame 53*d* is located just above the discharge hole 52*h*. The guide frame 53*d* has a pair of guide slots 53*e* for guiding the movement of the movable magnet Mg1, which will be described later, and the guide slots 53*e* are respectively formed in the inner surfaces of members of the guide frame 53*d*, which are prepared in a pair so as to be opposite to each other.

Further, the supply hole cover 54 serving to selectively open and close the supply hole 53*h* of the tank cover 53 is provided. The supply hole cover 54 has one end, which is hinged to the tank cover 53, and the other end, which is vertically rotated on the hinged end. The supply hole cover 54 is laid on the receipt stage 53*b* under the condition that the supply hole cover 54 closes the supply hole 53*h* of the tank cover 53.

A contacting protrusion 54*a* and a packing protrusion 54*b* are provided on the lower surface of the supply hole cover 54. The contacting protrusion 54*a* and the packing protrusion 54*b* are protruded downwardly from positions of the lower surface of the supply hole cover 54, corresponding to the circumference of the supply hole 53*h* of the tank cover 53 and the packing groove 53*a*, to designated lengths.

Under the condition that the supply hole cover 54 closes the supply hole 53*h* of the tank cover 53, the outer circumferential surface of the contacting protrusion 54*a* contacts the inner surface of the supply hole 53*h*. Further, under the condition that the supply hole cover 54 closes the supply hole 53*h* of the tank cover 53, the packing protrusion 54*b* is inserted into the packing groove 53*a*.

With reference to FIG. 2, there is provided the valve 55 for selectively opening and closing the discharge hole 52*h* of the tank main body 52. That is, the valve 55 serves to selectively supply the water stored in the water storage space 52*s* of the tank main body 52 to the ice tray. For this reason, the valve 55 is vertically movably installed under the condition that the valve 55 passes through the discharge hole 52*h* of the tank main body 52.

A valve bracket 56 of the valve 55 is provided along the circumference of the discharge hole 52*h* of the tank main body 52, and a water supply hole 56*h* for substantially supplying the water stored in the water storage space 52*s* to the ice tray therethrough is formed through the valve bracket 56.

The upper surface of the valve bracket 56 is downwardly inclined toward the water supply hole 56*h*. A receipt groove 56*a* is formed in a designated position of the upper surface of the valve bracket 56 adjacent to the water supply hole 56*h*, and the outer circumferential surface of a packing ring 58*a*, which will be described later, is laid on the receipt groove 56*a*.

An insertion groove 56*b* is formed in the upper surface of the valve bracket 56, and the insertion rib 52*r* of the tank main body 52 is inserted into the insertion groove 56*b*. A fixing hook 56*c* is provided on the upper surface of the valve bracket 56 inside the insertion groove 56*b*.

Here, the valve bracket 56 is fixed to the lower surface of the tank main body 52 by catching the fixing hook 56*c* onto the bottom surface of the tank main body 52 under the condition that the insertion rib 52*r* is inserted into the insertion groove 56*b*.

A valve main body 57, which passes through the water supply hole 56*h* of the valve bracket 56 and is vertically movable, is installed, and serves to selectively open and close the water supply hole 56*h* of the valve bracket 56. That is, when the water tank 51 is installed in the mounting space, the valve main body 57 moves upwardly by means of the attractive force between the movable magnet Mg1 and the stationary magnet Mg2 of the valve driving unit, and thus opens the water supply hole 56*h* of the valve bracket 56.

An insertion groove 57*a*, into which the inner circumferential surface of the packing ring 58*a* is inserted, is formed in one side of the outer circumferential surface of the valve main body 57. Further, a flange part 57*f*, the upper surface of which supports one end of a first elastic member 59, is provided on the lower end of the valve main body 57, and a water supply hole 57*h* is formed through a position of the flange part 57*f* corresponding to the water supply hole 56*h* of the valve bracket 56.

There is provided the packing ring 58*a* for filling a gap between the valve bracket 56 and the valve main body 57. The packing ring 58*a* prevents the leakage of the water stored in the water storage space 52*s* of the water tank 51 to the outside through the gap between the valve bracket 56 and the valve main body 57. The packing ring 58*a* vertically moves along the valve main body 57 under the condition that the inner circumferential surface of the packing ring 58*a* is inserted into the insertion groove 57*a*.

A packing member 58*b* is provided between the insertion rib 52*r* of the tank main body 52 and the insertion groove 56*b* of the valve bracket 56, and serves to prevent the leakage of the water stored in the water storage space 52*s* of the water tank 51 through the gap between the insertion rib 52*r* and the insertion groove 56*b* under the condition that the insertion rib 52*r* is inserted into the insertion groove 56*b*.

The first elastic member 59*a* is provided between the valve bracket 56 and the valve main body 57, and both ends of the first elastic member 59*a* are respectively supported by the lower surface of the valve bracket 56 and the upper surface of the flange part 57*f* of the valve main body 57.

The first elastic member 59*a* serves to prevent the water supply hole 56*h* of the valve bracket 56 from being voluntarily opened by the valve main body 57. For this reason, the first elastic member 59*a* provides the valve main body 57 restoring force in the direction of closing the water supply hole 56*h* of the valve bracket 56 (i.e., in the direction opposite to the attractive force between the movable magnet Mg1 and the stationary magnet Mg2).

In order to selectively move the valve main body 57 in the direction of opening the water supply hole 56*h* of the valve bracket 56, the movable magnet Mg1 and the stationary magnet Mg2 are provided. The movable magnet Mg1 is installed on the upper surface of the tank cover 53 such that the movable magnet Mg1 can move along the guide slots 53*e*, and the stationary magnet Mg2 is provided on the upper surface of the valve main body 57.

The movable magnet Mg1 and the stationary magnet Mg2 have different polarities so as to generate the attractive force therebetween. The degree of the attractive force between the movable magnet Mg1 and the stationary magnet Mg2 is enough to overcome the restoring force of the first elastic member 59*a* and thus move the valve main body 57 upwardly, when the movable magnet Mg1 is located adjacent to the stationary magnet Mg2, for example, just above the discharge hole 52*h*.

That is, only when the movable magnet Mg1 moves to a position just above the discharge hole 52*h*, the attractive force between the movable magnet Mg1 and the stationary magnet Mg2 has a value larger than the elastic force of the first elastic member 59*a*. Accordingly, the valve main body 57 moves upwardly by means of the attractive force between the movable magnet Mg1 and the stationary magnet Mg2, and thus opens the water supply hole 56*h* of the valve bracket 56.

Then, when the movable magnet Mg1 becomes distant from the position just above the discharge hole 52*h*, the attractive force between the movable magnet Mg1 and the stationary magnet Mg2 has a value smaller than the elastic force of the first elastic member 59*a*. Accordingly, the valve main body 57 moves downwardly by means of the restoring force of the first elastic member 59*a*, and thus closes the water supply hole 56*h* of the valve bracket 56.

A lever L is provided at one side of the movable magnet Mg1. The lever L serves to easily move the movable magnet Mg1 along the guide slots 53*e*. For example, a user holds the level L by his/her hand, and then moves the movable magnets Mg1 to the position just above the discharge hole 52*h* along the guide slots 53*e*.

Further, in the process of installing the water tank 51 in the mounting space, the level L is moved by the an interlocking protrusion 14*a* provided on the lower surface of a door basket 14 forming the ceiling of the mounting space, and thus moves the movable magnets Mg1 to the position just above the discharge hole 52*h* along the guide slots 53*e*.

As shown in FIG. 2, second elastic members 59*b* are prepared in a pair, and are respectively provided in the guide slots 53*e*. The second elastic members 59*b* provide the movable magnet Mg1 restoring force in the direction being distant from the stationary magnet Mg2. Both ends of each of the second elastic members 59*b* are respectively fixed to one end of the corresponding guide slot 53*e* distant from the discharge hole 52*h* and one side of the movable magnet Mg1.

Hereinafter, functions of the water tank of the present invention and a refrigerator having the same will be described in more detail with reference to the accompanying drawings.

Figure 3:
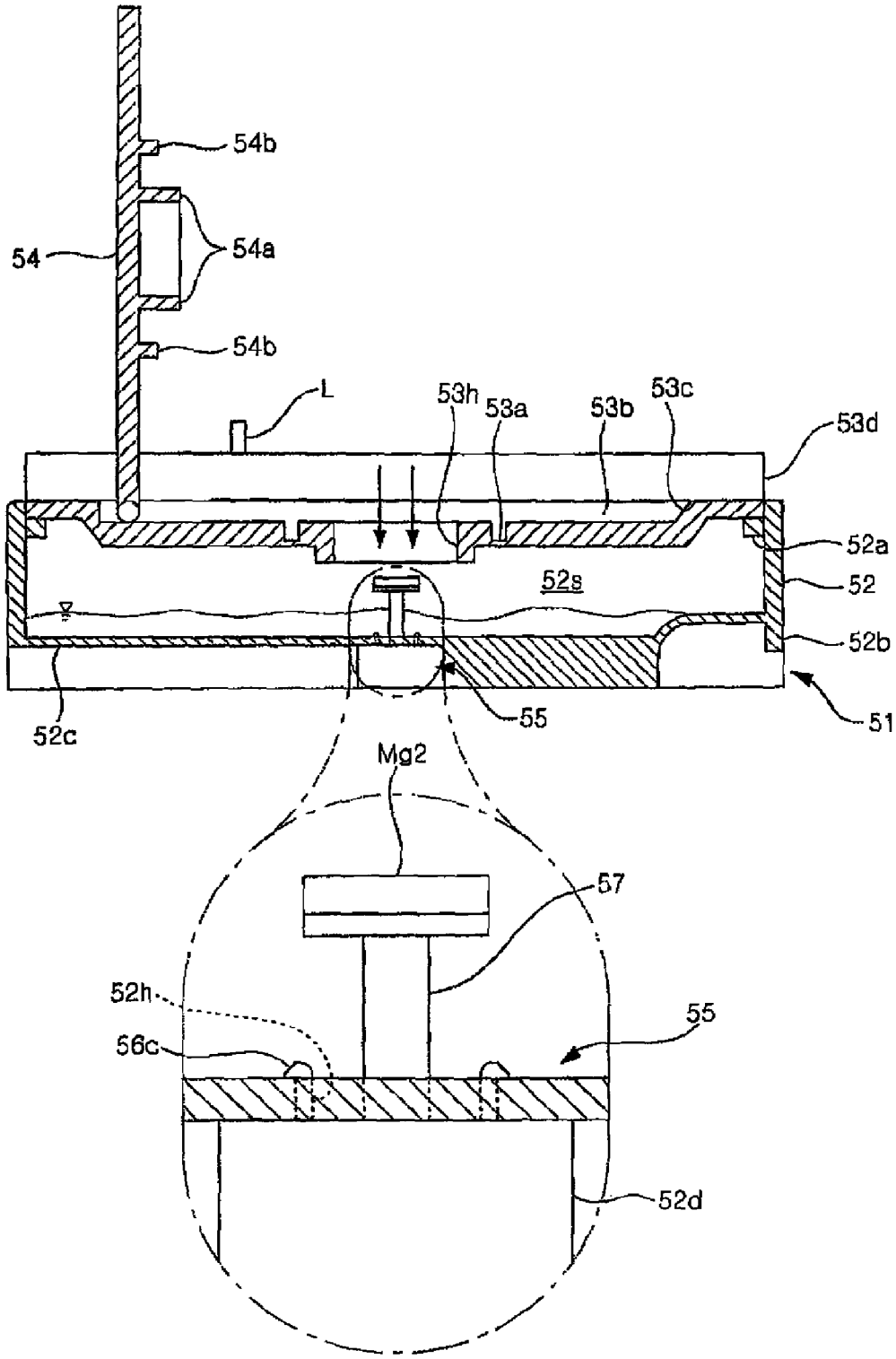
FIGS. 3 and 4 are longitudinal sectional views illustrating a process of storing water in a water storage space of the water tank of FIG. 1.
Figure 4:
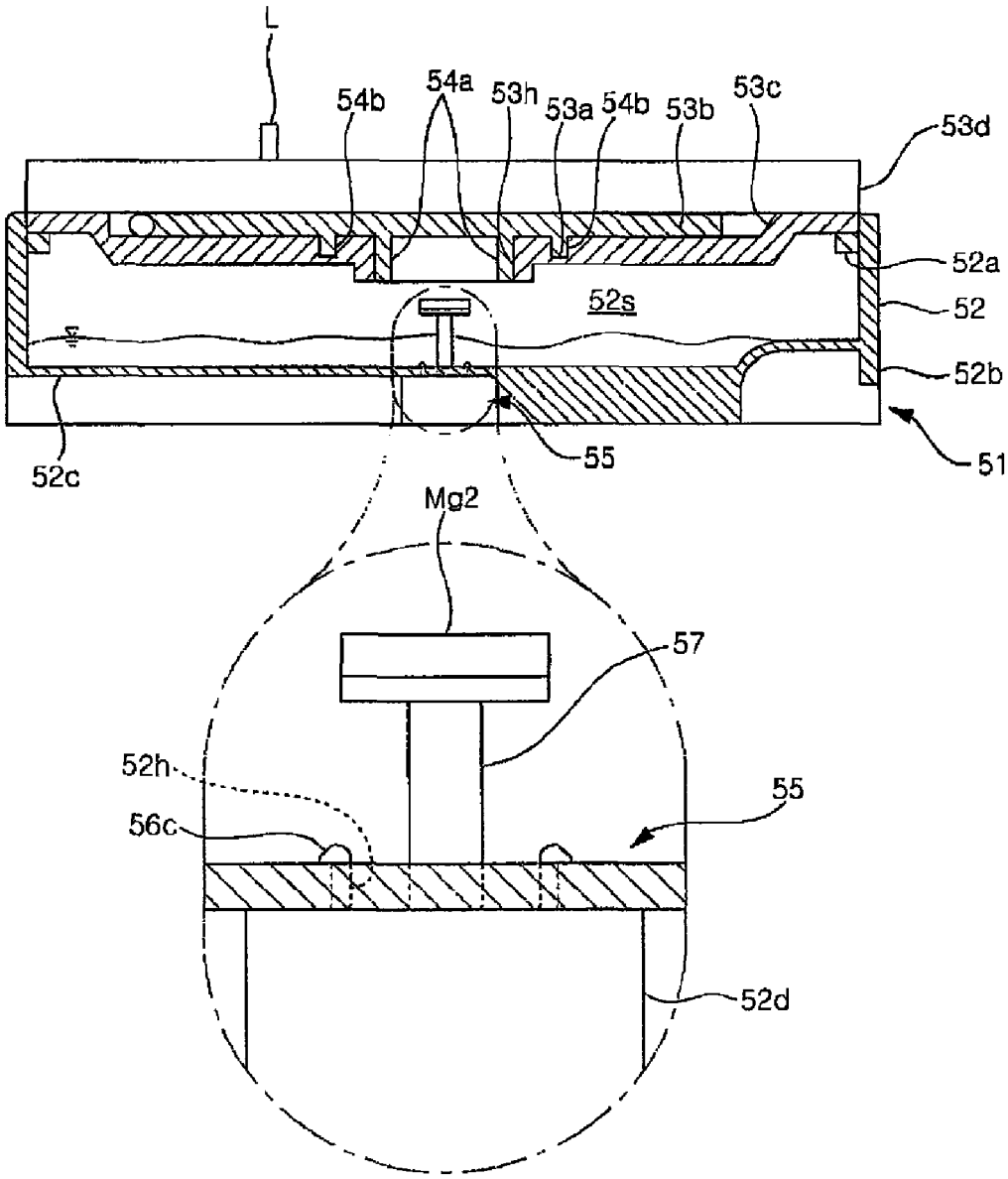

FIGS. 3 and 4 are longitudinal sectional views illustrating a process of storing water in the water storage space of the water tank of FIG. 1, and FIGS. 5 to 7 are longitudinal sectional views illustrating a process of opening and closing the valve of the water tank of FIG. 1.

First, as shown in FIG. 3, the supply hole cover 54 is rotated at a designated angle against the tank cover 53, and thus opens the supply hole 53*h*. Then, water is stored in the water storage space 52*s* of the water tank 51 through the supply hole 53*h*. Here, the supply hole 53*h* of the tank cover 53 and the discharge hole 52*h* of the tank main body 52 are separated from each other at a designated distance in the horizontal direction.

Accordingly, it is possible to prevent water from being directly discharged through the discharge hole 52*h* of the tank main body 52 in the process of storing the water in the water storage space 52*s* of the water tank 51 through the supply hole 53*h* of the tank cover 53.

When the water is stored in the water storage space 52*s* of the water tank 51, as shown in FIG. 4, the supply hole cover 54 is rotated on its one end, and thus closes the supply hole 53*h*. Under the condition that the supply hole 53*h* is closed, the water tank 51 is installed in the mounting space.

Figure 5:
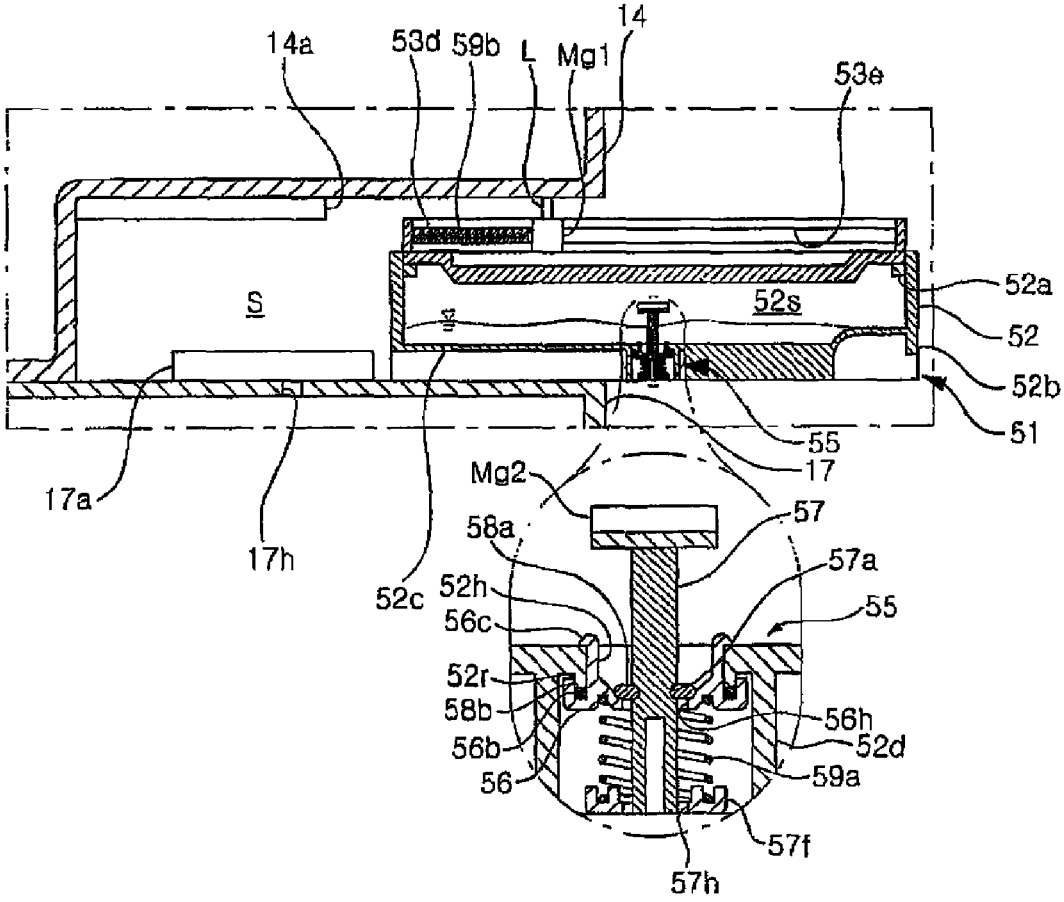
FIGS. 5 to 7 are longitudinal sectional views illustrating a process of opening and closing a valve of the water tank of FIG. 1.

More specifically, as shown in FIG. 5, the water tank 51 slides into the mounting space, and the lower surface of the tank main body 52 contacts the upper surface of the first ice maker housing 17.

Further, the upper surface of the tank cover 53 contacts the lower surface of the door basket 14. Here, the water tank 51 slides under the condition that the guide frame 53*d* of the water tank 51 is inserted into a groove 14*b* formed in the lower surface of the door basket 14.

Figure 6:
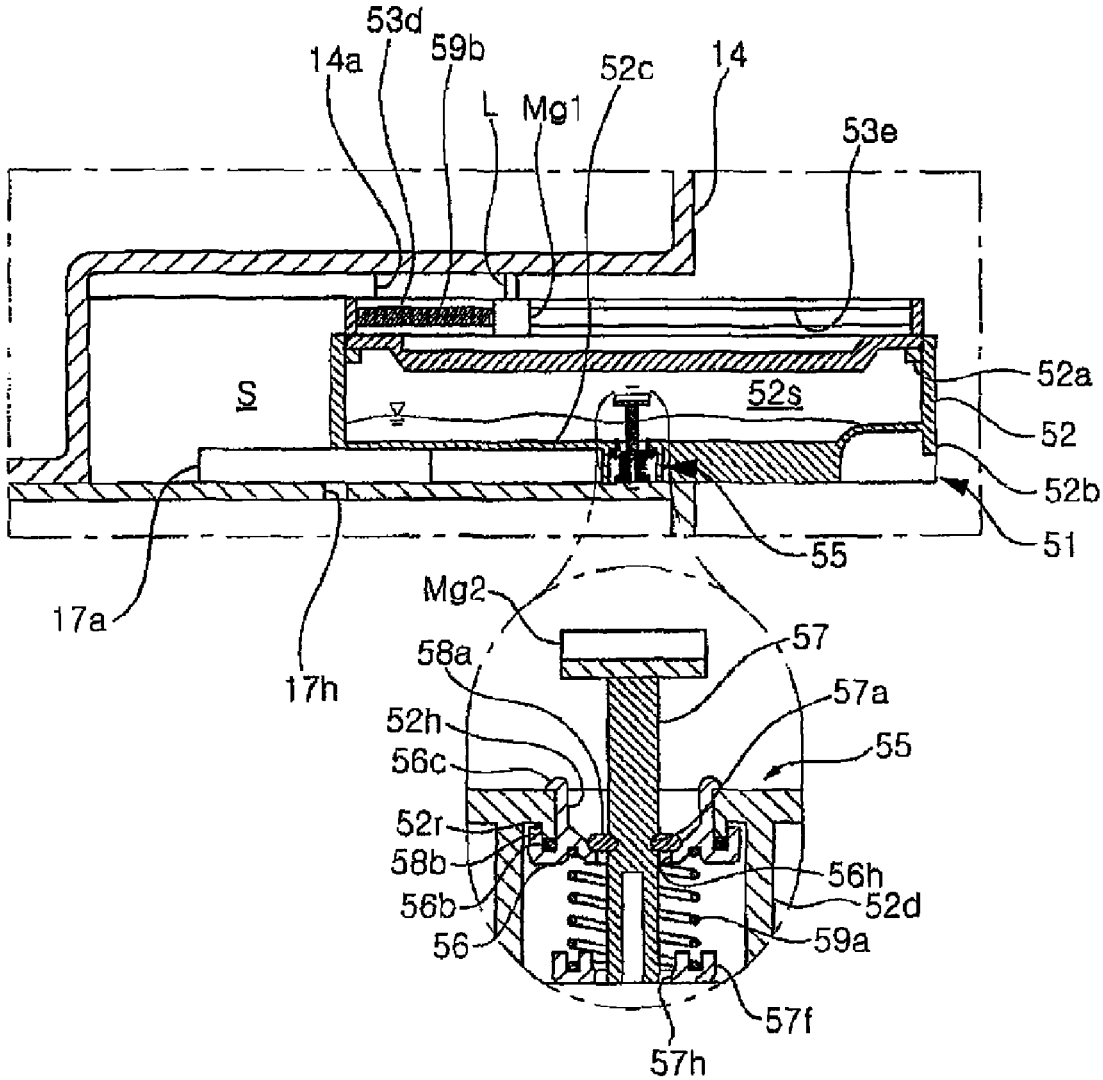

Thereafter, as shown in FIG. 6, when the water tank 51 continuously slides into the mounting space, the water tank 51 slides under the condition that the guide rib 17*a* of the first ice maker housing 17 is inserted into the guide groove 52*c* of the tank main body 52. That is, the installation of the water tank 51 is guided by the guide rib 17*a* and the guide groove 52*c*.

Further, the lever L provided on the movable magnet Mg1 of the water tank 51 is pushed to the right, as shown in FIG. 6, by the interlocking protrusion 14*a* provided in the groove 14*b*. Accordingly, the movable magnet Mg1 moves to the right, i.e., towards the discharge hole 52*h* of the water tank 51.

Figure 7:
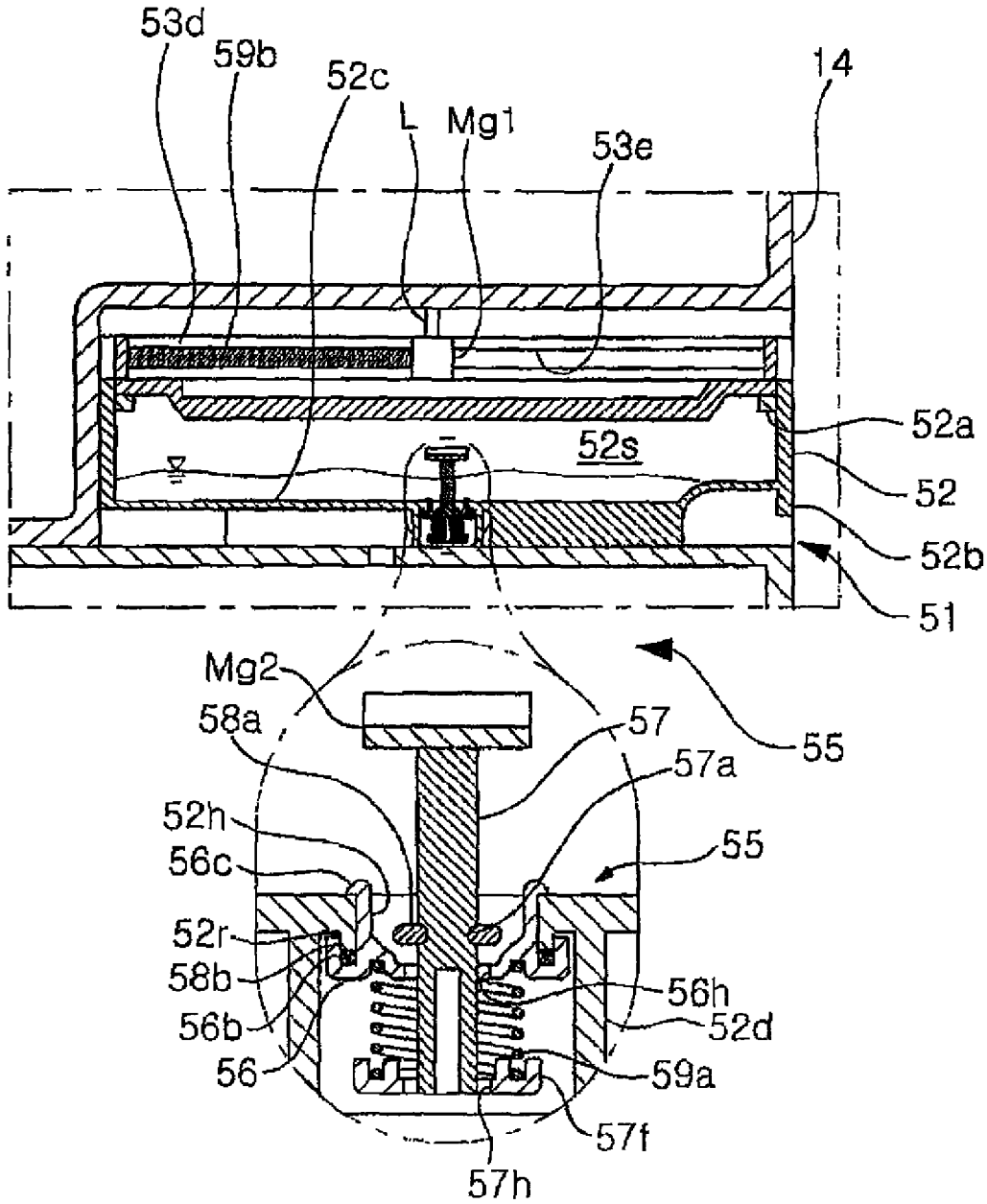
Figure 8:
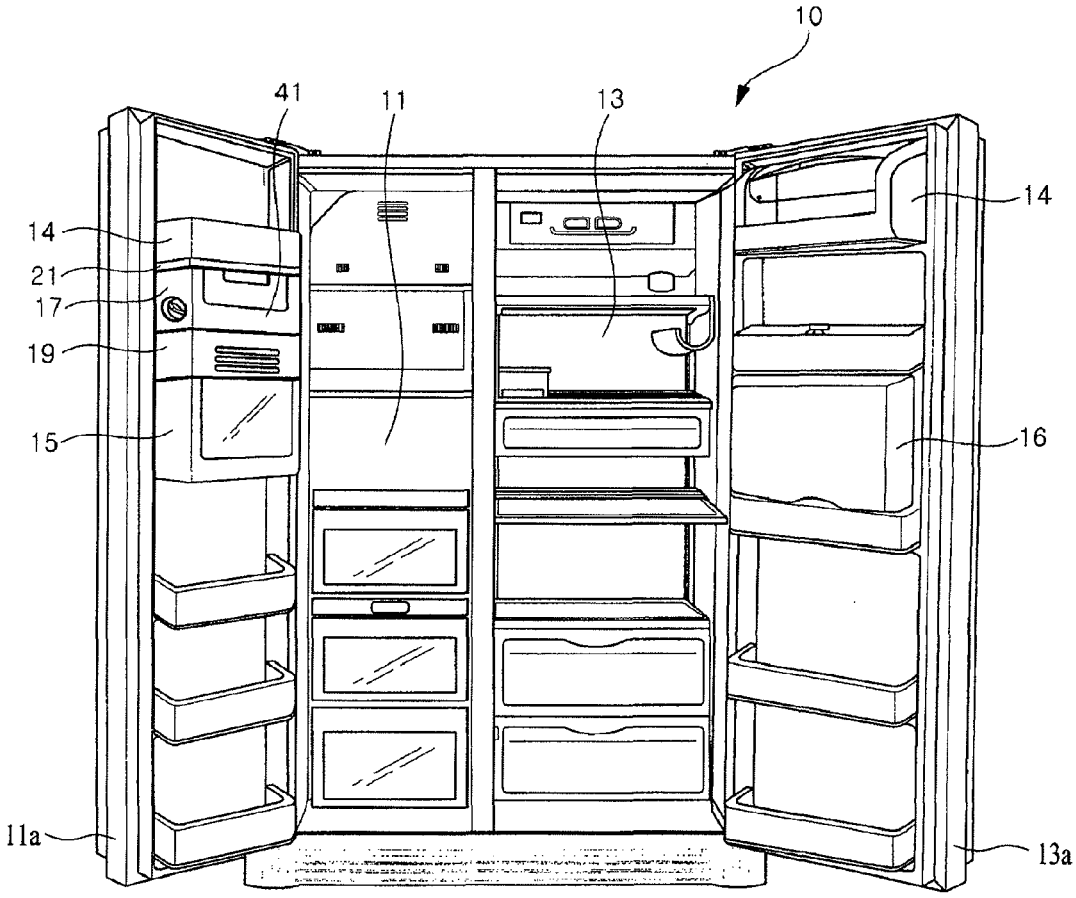
FIG. 8 Related Art
FIG. 8 is a front view illustrating the internal structure of a conventional refrigerator.
Figure 9:
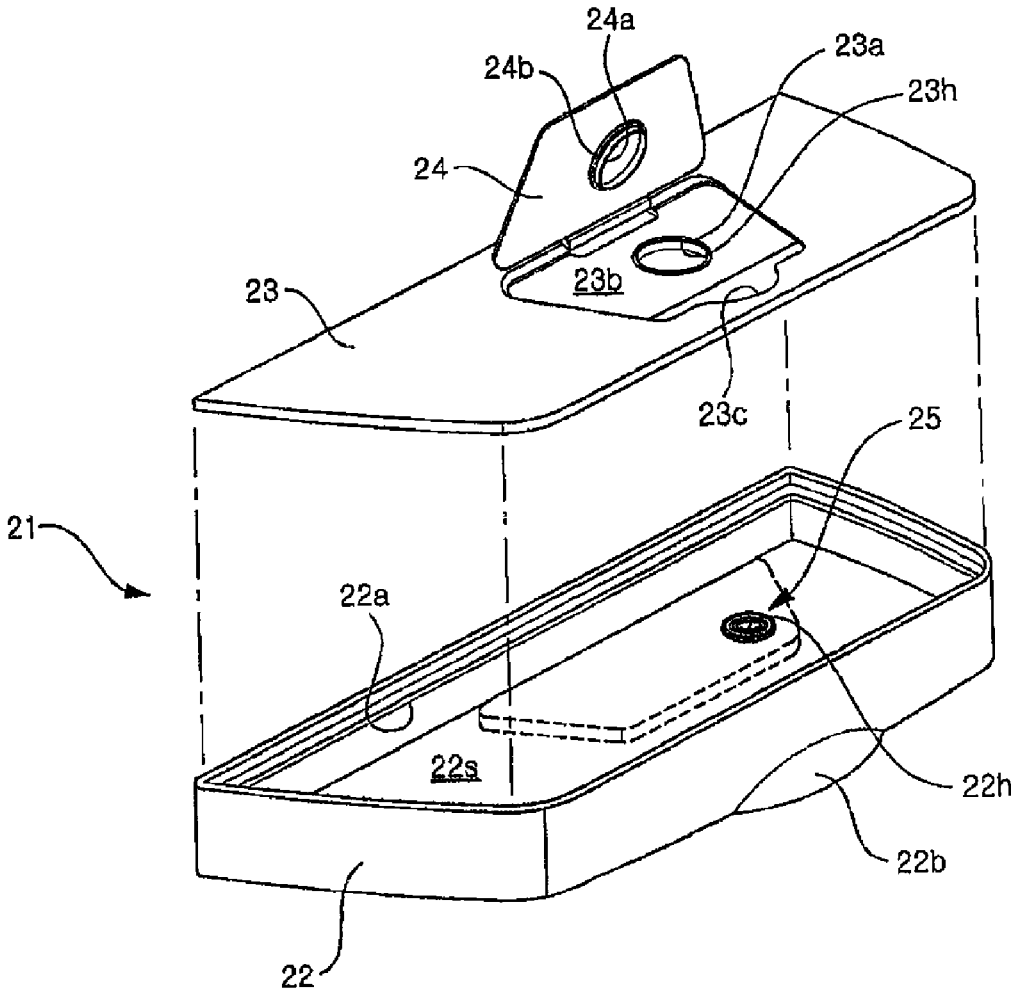
FIG. 9 Related Art
FIG. 9 is an exploded perspective view of a water tank provided in the refrigerator of FIG. 8.
Figure 10:
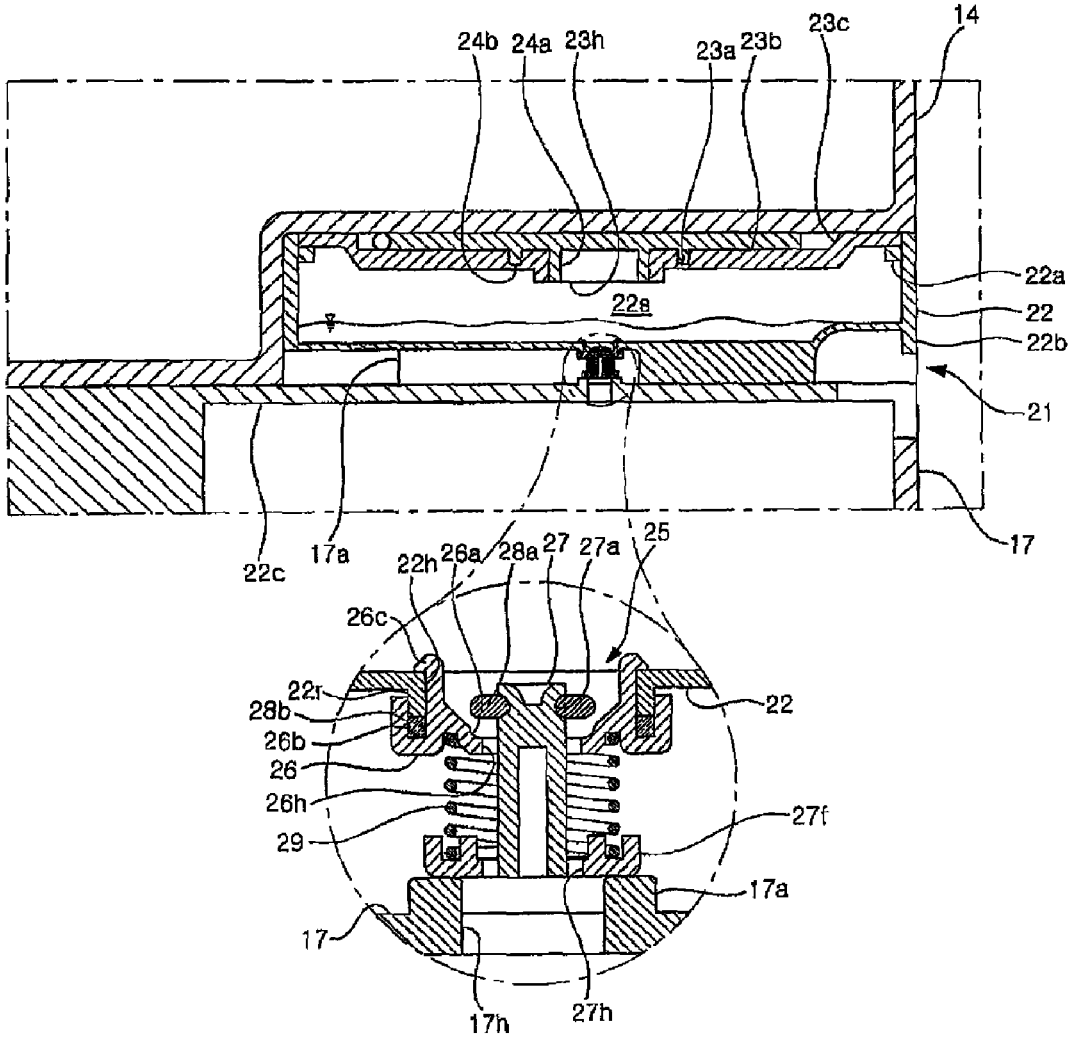
FIG. 10 Related Art
FIG. 10 is a longitudinal sectional view of the water tank in a state in which the water tank is installed on a door of the refrigerator of FIG. 8.

Thereafter, as shown in FIG. 7, when the water tank 51 is completely installed in the mounting space, the discharge hole 52*h* of the water tank 51 is located at a position corresponding to the water supply hole 17 of the first ice maker housing 17. Further, the lever L continuously moves to the right by the interlocking protrusion 14*a*, and thus the movable magnet Mg1 is located just above the discharge hole 52*h* of the water tank 51.

Then, the valve main body 57 overcomes the elastic force of the first elastic member 59*a* due to the attractive force between the movable magnet Mg1 and the stationary magnet Mg2, and thus moves upwardly, i.e., toward the inside of the water tank 51.

Accordingly, the discharge hole 52*h* of the water tank 51, substantially the water supply hole 56*h* of the valve bracket 56, is opened, and the water stored in the water storage space 52*s* of the water tank 51 is supplied to the first ice maker housing 17 through the water supply hole 56*h* of the valve bracket 56 and the water supply hole 57*h* of the valve main body 57.

The water supplied through the water supply hole 56*h* of the valve bracket 56 is supplied to the ice tray via the water supply hole 17*h* of the first ice maker housing 17. Here, the water leak prevention rib 52*d* provided on the lower surface of the tank main body 52 prevents the water stored in the water storage space 52*s* of the water tank 51 from leaking to the upper surface of the first ice maker housing 17 in the process of supplying the water to the ice tray.

On the other hand, in order to store water in the water storage space 52*s* of the water tank 51 or wash the water tank 51, the water tank 51 is removed from the mounting space.

A process of removing the water tank 51 from the mounting space is carried out in the reverse order of the process of installing the water tank 51 in the mounting space. That is, a user holds the level L by his/her hand, and moves the movable magnets Mg1 to the right in FIGS. 5 to 7. Thereby, the water tank 51 is removed from the mounting space.

Then, the movable magnet Mg1, which was located just above the stationary magnet Mg2, i.e., the discharge hole 52*h* of the water tank 51, by the locking protrusion 14*a*, is distant from the position just above the discharge hole 52*h* by the elastic force of the second elastic members 59*b*. Accordingly, the valve main body 57 moves downwardly, and thus closes the water supply hole 56*h* of the valve bracket 56.

The above-described water tank of the present invention and the refrigerator having the same, exhibit effects, as described below.

The discharge hole for supplying water stored in the water storage space in the water tank to the outside of the water tank is selectively opened and closed by the valve moving by means of the attractive force between the movable and stationary magnets of the valve driving unit, thereby preventing the water stored in the water storage space from leaking through the discharge hole in a process of operating the valve, and thus allowing the refrigerator to be more cleanly used.

Further, as soon as the water tank is installed on the mounting space of the refrigerator, the water stored in the water storage space in the water tank can be supplied to the outside of the water tank. Thereby, any separate work for supplying the water stored in the water tank to the outside of the water tank is not required. Moreover, since the movable and stationary magnets are returned to their original positions by means of the restoring force of the elastic members, the water tank is conveniently installed in or removed from the mounting space of the refrigerator.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator having a water tank, said water tank comprising:

a tank main body installed on the rear surface of a door, and provided with a water storage space formed therein and a discharge hole;

a tank cover connected to the tank main body for opening and closing the water storage space;

a valve movably installed in the tank main body for opening and closing the discharge hole; and a valve driving unit moving the valve so as to cause the valve to open and close the discharge hole, and including a first magnet movably installed on the tank cover and a second magnet installed on the valve, wherein a lever for facilitating the movement of the first magnet is protruded from the first magnet, and wherein the water tank is installed under a door basket, and an interlocking protrusion for moving the lever close to the second magnet, when the water tank is installed, is formed on the door basket.

2. The refrigerator according to claim 1, wherein the tank cover includes guide slots for guiding the movement of the first magnet.

3. The refrigerator according to claim 1, wherein the valve includes a first elastic member for providing restoring force in the direction opposite to the attractive force between the first magnet and the second magnet.

4. The refrigerator according to claim 1, wherein the valve includes:

a valve bracket installed in the discharge hole and provided with a water supply hole; and a valve main body provided with the second magnet installed thereon and serving to open and close the water supply hole.

5. The refrigerator according to claim 1, wherein the tank cover includes second elastic members for providing restoring force in the direction of moving the first magnet from the second magnet to the distance large enough to prevent the first magnet from exerting enough force on the second magnet to move the second magnet in the vertical direction to actuate the valve.

6. The refrigerator according to claim 1, wherein a water leak prevention rib is provided on the lower surface of the tank main body adjacent to the discharge hole.

* * * * *